US010060206B2

(12) United States Patent
Nilsson

(10) Patent No.: US 10,060,206 B2
(45) Date of Patent: Aug. 28, 2018

(54) PERCUSSION ROCK DRILLING MACHINE AND DRILL RIG

(75) Inventor: Ulf Nilsson, Örebro (SE)

(73) Assignee: Epiroc Rock Drills Aktiebolag, Orebro (SE)

( * ) Notice: Subject to any disclaimer, the term of this patent is extended or adjusted under 35 U.S.C. 154(b) by 683 days.

(21) Appl. No.: 13/261,295

(22) PCT Filed: Dec. 6, 2010

(86) PCT No.: PCT/SE2010/051339

§ 371 (c)(1),
(2), (4) Date: May 23, 2012

(87) PCT Pub. No.: WO2011/084093

PCT Pub. Date: Jul. 14, 2011

(65) Prior Publication Data

US 2012/0285747 A1 Nov. 15, 2012

(30) Foreign Application Priority Data

Jan. 11, 2010 (SE) ..... 1050006

(51) Int. Cl.

| | |
|---|---|
| ***E21B 4/14*** | (2006.01) |
| ***E21B 10/38*** | (2006.01) |
| ***E21B 21/00*** | (2006.01) |
| ***E21B 21/02*** | (2006.01) |
| ***E21B 17/03*** | (2006.01) |

(52) U.S. Cl.
CPC ..... *E21B 21/02* (2013.01); *E21B 17/03* (2013.01)

(58) Field of Classification Search
CPC ... E21B 4/14; E21B 6/00; E21B 10/38; E21B 21/00; E21B 4/06; B23Q 11/0046; B25D 17/06; B25D 17/20
USPC ..... 173/80, 199, 138, 73
See application file for complete search history.

(56) References Cited

U.S. PATENT DOCUMENTS

| | | | | |
|---|---|---|---|---|
| 975,891 | A * | 11/1910 | Prellwitz | 173/80 |
| 1,081,637 | A * | 12/1913 | Taylor | 173/80 |
| 1,232,111 | A * | 7/1917 | Smith | 173/80 |
| 1,326,825 | A * | 12/1919 | Andersson | 173/80 |
| 1,554,985 | A * | 9/1925 | Bayles | 173/80 |
| 1,704,053 | A * | 3/1929 | Miller | 285/111 |
| 1,739,141 | A * | 12/1929 | Hansen | 173/199 |
| 2,147,045 | A | 2/1939 | Lembke | |
| 2,200,444 | A * | 5/1940 | Everheart et al. | 173/80 |
| 2,292,867 | A * | 8/1942 | Charles | 173/178 |
| 3,227,230 | A * | 1/1966 | Lagerstrom | 175/214 |

(Continued)

FOREIGN PATENT DOCUMENTS

| | | |
|---|---|---|
| DE | 297 16 724 U1 | 11/1997 |
| GB | 465770 | 5/1937 |

(Continued)

*Primary Examiner* — Kipp C Wallace
(74) *Attorney, Agent, or Firm* — Mark P. Stone

(57) ABSTRACT

The present invention relates to a percussion rock drilling machine comprising a front head (1), in which front head (1) are arranged a flush housing (26) and a flush connector (25) for flushing medium. According to the invention, a sheath (31) of rust-resistant material is arranged at the front head (1) around the flush housing (26), such that flushing medium can enter the flush housing (26) through the flush connector (25), without coming into contact with the front head (1).

9 Claims, 5 Drawing Sheets

(56) References Cited

U.S. PATENT DOCUMENTS

| | | | | |
|---|---|---|---|---|
| 3,893,521 | A | 7/1975 | Bailey et al. | |
| 5,695,014 | A * | 12/1997 | Jenne | 175/21 |
| 6,547,891 | B2 | 4/2003 | Linden et al. | |

FOREIGN PATENT DOCUMENTS

| | | | |
|---|---|---|---|
| GB | 790610 | | 2/1958 |
| GB | 817863 | A | 8/1959 |
| WO | WO01/65058 | | 9/2001 |
| WO | WO01/65059 | | 9/2001 |
| WO | WO03/076761 | | 9/2003 |
| WO | WO03/078788 | | 9/2003 |
| WO | WO2004/074624 | | 9/2004 |
| WO | WO2009/118497 | | 10/2009 |
| WO | WO2009/148375 | A1 | 12/2009 |

* cited by examiner

PERCUSSION ROCK DRILLING MACHINE AND DRILL RIG

TECHNICAL AREA

The present invention relates to a percussion rock drilling machine according to the introduction to claim 1 and a drill rig equipped with such a rock drilling machine.

THE PRIOR ART

A percussion rock drilling machine comprises a cover in which a piston moves forwards and backwards and impacts upon a shank adapter. Furthermore, rotation is transferred to the shank adapter from a rotary motor. Impact energy and rotation are subsequently transferred from the shank adapter through one or several drill rods and a drill bit to the rock, such that a borehole is created.

The drilling cuttings that are broken loose during rock drilling must be continuously transported away from the borehole. This is carried out with the aid of a flushing medium, for example air or water, which is led in at the front head of the drilling machine to the shank adapter through a flush connector and a flush housing. The flushing medium then passes through a passage in the shank adapter and the drill rods and finally passes out through the drill bit to the borehole, whereby the drilling cuttings are flushed out through the space between the drill rods and the edges of the borehole. An example of this procedure can be seen in WO2009/148375.

The front head of the drilling machine is often manufactured from case-hardened steel, which has good mechanical properties and withstands mechanical load. Furthermore, case-hardened steel is relatively cheap and easy to work. One disadvantage of case-hardened steel, however, is that rust easily arises, and the steel therefore resists poorly a flushing medium such as water.

DESCRIPTION OF THE INVENTION

According to the invention, a percussion rock drilling machine is revealed comprising a front head, in which a flush housing and a flush connector for flushing medium are arranged. A sheath of rust-resistant material is arranged at the front head around the flush housing, such that flushing medium can enter the flush housing through the flush connector, without coming into contact with the front head.

The task of the sheath is to protect against rust solely where this is necessary, while the remainder of the front head can be manufactured from traditional case-hardened steel, which is cheaper, easier to work, and has better mechanical properties. The invention thus combines the positive properties of case-hardened steel with the rust-protective effect of the rust-resistant material. The working of the rust-resistant material, which is more difficult, is minimised in that the rust-resistant components are relatively small fittings. The flush connector and the sheath are not exposed to the high impact forces from the stop ring of the drilling machine and thus they do not need to be so mechanically strong.

According to one aspect of the invention, a flush connector is connected to the flush housing such that the flush connector enters through a hole in the sheath. Since the flush connector enters the sheath but not the flush housing, it is possible also to use without problems a flush housing that is mounted and demounted by means of rotation.

DESCRIPTION OF DRAWINGS

The invention will be described in more detail with the aid of a preferred embodiment and with reference to the attached drawings, of which

PREFERRED EMBODIMENT

Figure 1:
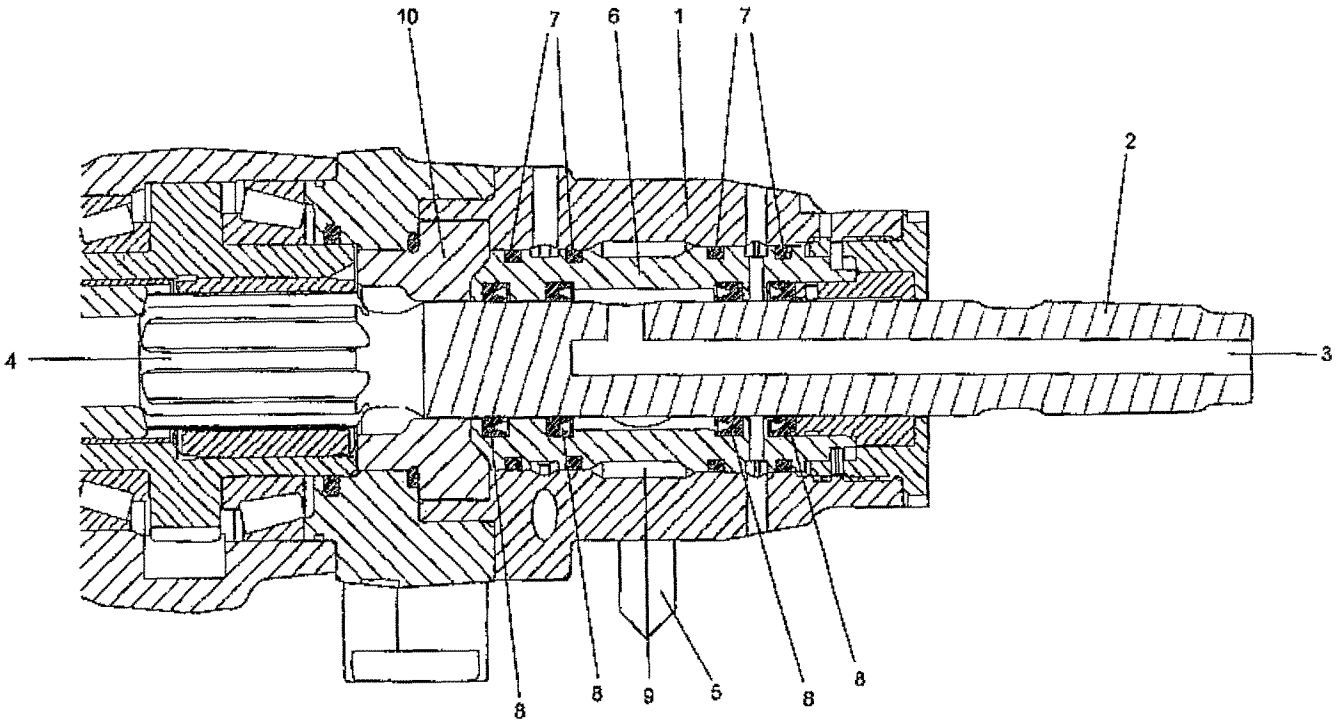
Fig 1 Prior Art
FIG. 1 shows a section through a front head of a rock drilling machine according to WO2009/148375.

FIG. 1 shows a front head 1 of a rock drilling machine according to WO2009/148375. A shank adapter 2 is arranged in the front head 1. The shank adapter 2 transfers impact energy, rotation and a feed force from a piston 4 and a rotary motor (not shown in the drawing) to rock, through one or several drill rods (not shown in the drawing) and a drill bit (not shown in the drawing).

A stop ring 10 is arranged to protect the shank adapter 2. If the drill bit is impacting air instead of rock because, for example, the drill bit encounters a cavity in the rock or because it is necessary to break open the threads between the drill rods, the stop ring 10 prevents the shank adapter 2 from moving too much in the axial direction, and this reduces the risk of damage.

The shank adapter 2 comprises also a flushing passage 3 for the transfer of flushing medium, such as air or water, through the drill rods and the drill bit to the rock in order to rinse away drilling cuttings that are formed during the drilling of a borehole.

The flushing medium is led in to the shank adapter 2 through a flush connector 5 and a flush housing 6. The flush connector 5 and the flush housing 6 are manufactured from stainless steel and are sealed from contact with the front head 1 by first seals 7, and they are sealed from contact with the shank adapter 2 by second seals 8. A region 9 is located between the first seals 7 in which the flushing medium comes into contact with the front head 1. It is desirable to manufacture the front head 1 from case-hardened steel, since this material withstands mechanical loads well, is relatively cheap and easy to work. However, case-hardened steel does not resist rust very well, and this means that if the flushing medium is water or some other aggressive flushing medium, then rust can arise in, for example, the region 9.

An alternative in this case would then be to manufacture the complete front head 1 from stainless steel. While it is true that stainless steel resists rust, the material is more brittle and withstands mechanical loads more poorly, leading to the risk of cracks arising. Impact forces from the stop ring 10 of the drilling machine occur often in the front head 1. Furthermore, stainless steel is more expensive and more difficult to work, particularly when in the form of such a large shell component as the front head 1. A rust-resistant front head would require reinforcement across, for example, its connection with the rest of the drilling machine, above that required by a front head manufactured from case-hardened steel.

Figure 2:
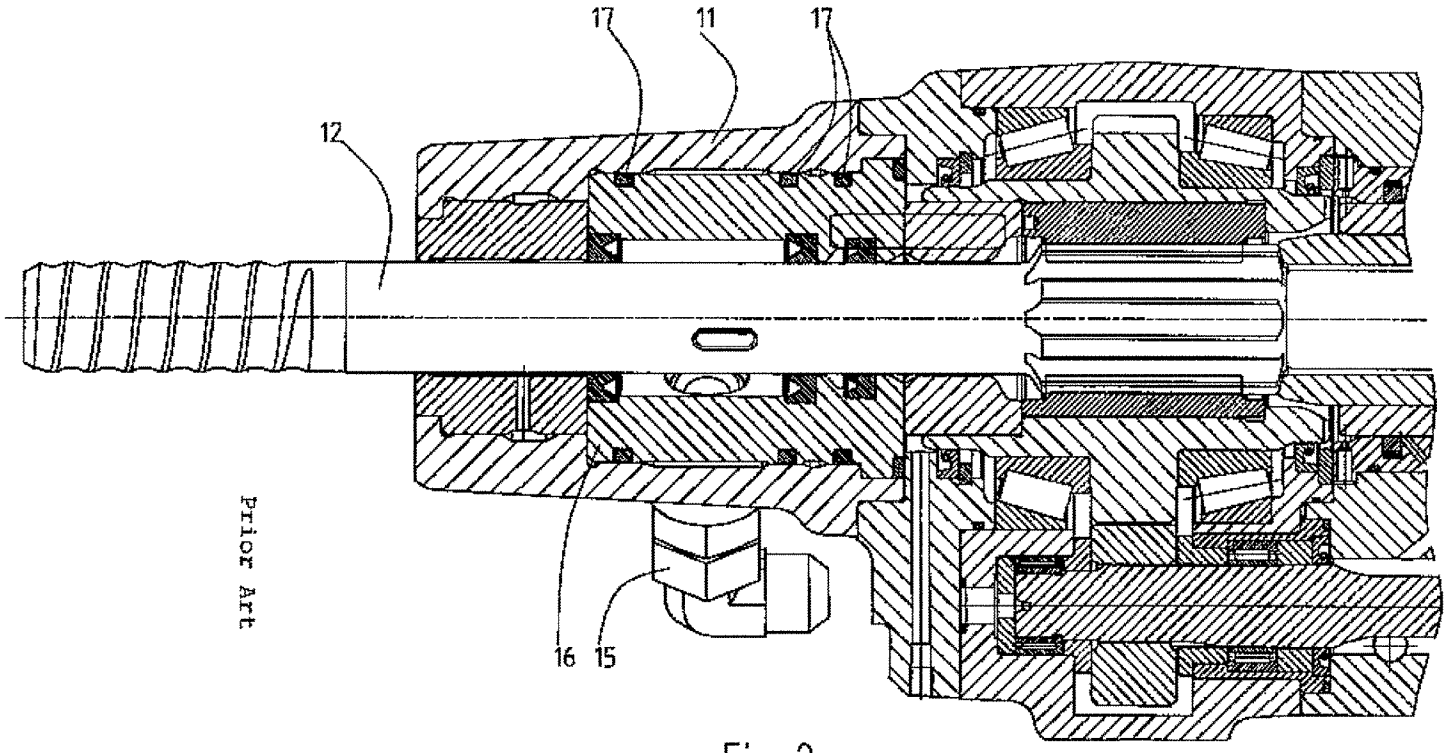
FIG. 2 shows a section through a front head of a second rock drilling machine.

FIG. 2 shows a rock drilling machine with a front head 11. Flushing medium is led in to the shank adapter 12 through a flush connector 15 and a flush housing 16. The flush housing 16 is sealed from contact with the front head 11 by seals 17. The flush connector 15 penetrates the flush housing 16 a certain distance in order to avoid the flushing medium coming into contact with the front head 11. One disadvantage with this is that dimensions of both the flush housing 15 and the flush connector 16 must be accurately manufactured in order for these to fit together, and this makes the manufacture more expensive. Furthermore, the dimensions will be changed through wear during operation. This means that the connection between the flush housing 16 and the flush connector 15 must absorb an ever-increasing part of the load, particularly when impacts occur. This risks leading to that the flush housing 16, for example, cracks and breaks.

Such a solution would give problems also with the rock drilling machine according to WO2009/148375, since the design there is such that the flush housing is rotated during mounting and demounting.

Figure 3:
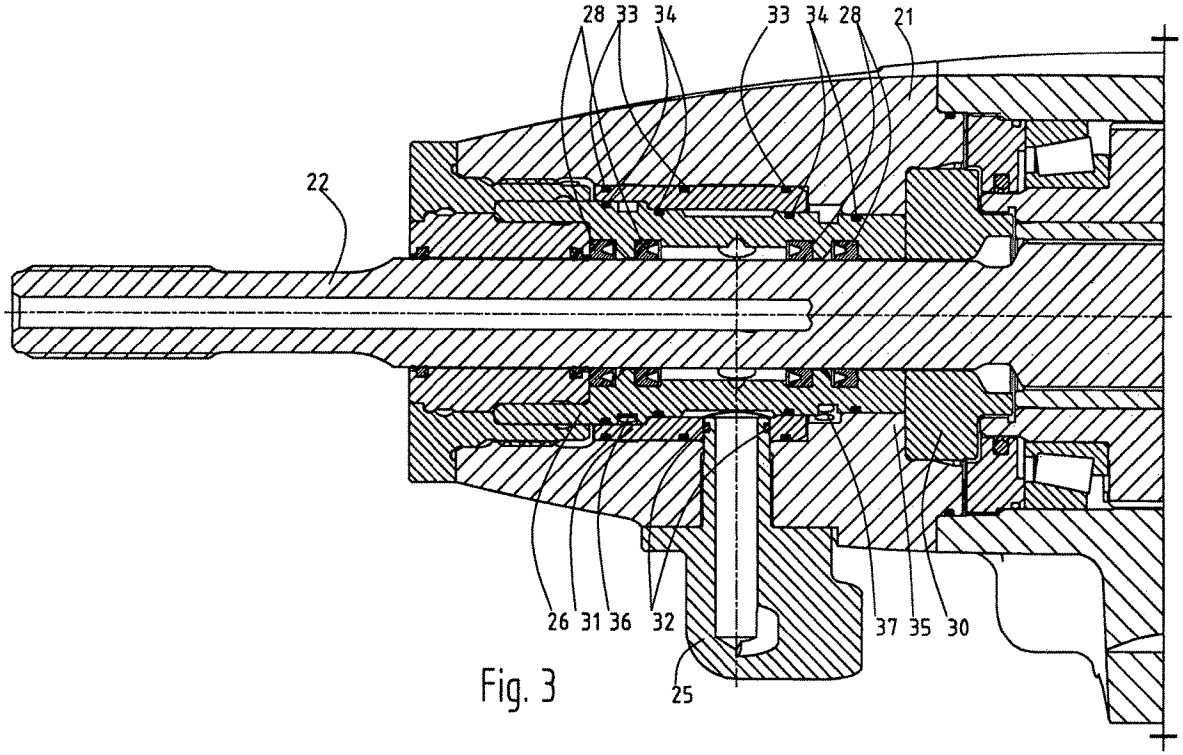
FIG. 3 shows a section through a front head of a rock drilling machine according to the invention.
Figure 4:
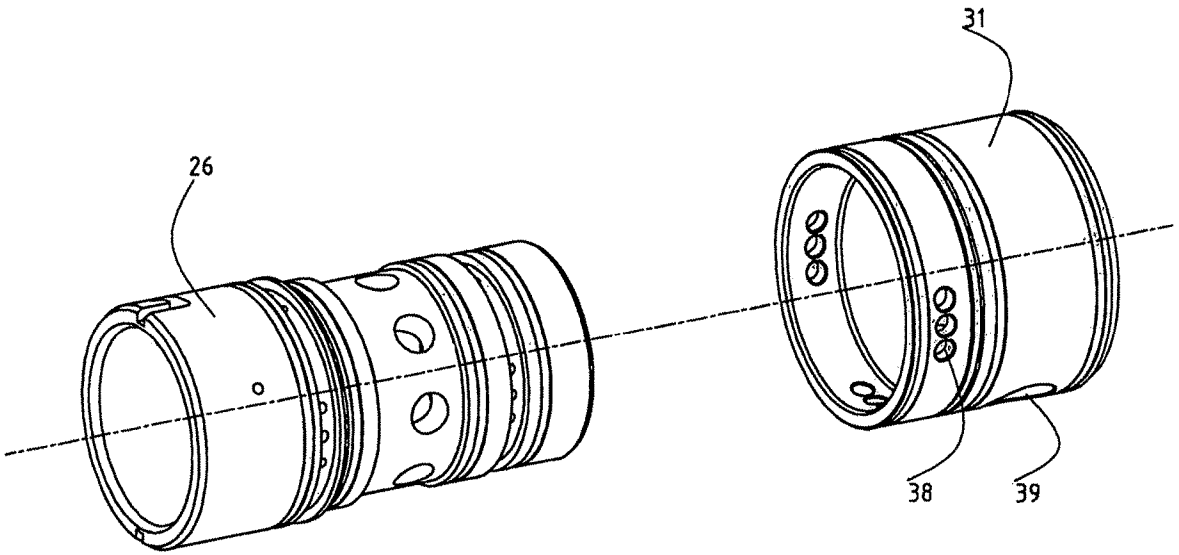
FIG. 4 shows an overview of a flush housing and a sheath according to the invention.
Figure 5:
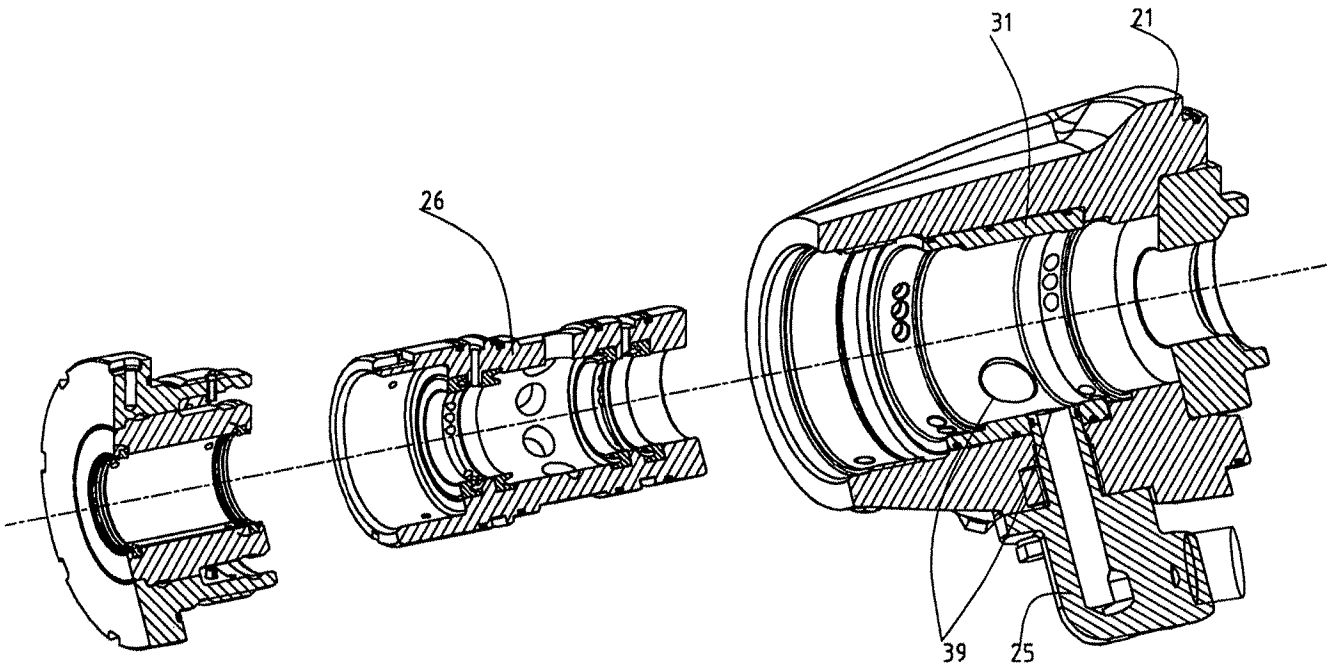
FIG. 5 shows an overview in section of a sheath according to the invention mounted in a front head.

A solution for a rock drilling machine according to the invention is shown in FIGS. 3-5 that solves all of the problems described above. A front head 21 is manufactured from case-hardened steel or similar material that has good mechanical properties. A shank adapter 22 and a stop ring 30 are arranged within the front head 21 in conventional manner.

Flushing medium is led into the drilling machine through a rust-resistant flush connector 25 to a rust-resistant flush housing 26, through a rust-resistant sheath 31 that has been pressed into the front head 21 and that surrounds the flush housing 26. "Rust-resistant" is here not to be interpreted as referring solely to stainless steel: it may be another rust-resistant material such as plastic. The flush connector 25 penetrates into the sheath 31 a certain distance in a hole 39 that has been arranged for this purpose. It may be arranged on certain rock drilling machines such that it is possible to select whether it is desired to place the flush connector 25 on the right side or the left side of the rock drilling machine, and in this case the sheath 31 has, naturally, two holes 39, see FIG. 5.

As illustrated by FIGS. 3-5, the housing 26 and the sheath 31 have aligned openings such that the flushing medium enters the flush housing from the flush connector through aligned openings in both the sheath and the flush housing.

First seals 32 are arranged in grooves on the flush connector 25 in order to create a seal between the flush connector 25 and the sheath 31. Second seals 33 are arranged in grooves on the sheath 31 in order to create a seal between the sheath 31 and the front head 21. Third seals 34 are arranged in grooves on the flush housing 26 in order to create a seal between the flush housing 26 and the sheath 31, and also—possibly—the front head 21. This is carried out in such a manner that the flushing medium does not come into contact in normal circumstances with the case-hardened steel, which is liable to attack by rust, in the front head 21. Furthermore, fourth seals 28 are arranged in the flush housing in order to create a seal with the shank adapter 22.

The sheath 31 may have one of a number of appearances. It is appropriate, in order to avoid mechanical loads, that the sheath 31 does not extend the full distance to the stop ring 30, but rather that the front head 21 has a flange 35 between the sheath 31 and the stop ring 30, which flange absorbs the load from the stop ring 30.

In order to be able to detect leaks, a front 36 and a rear 37 telltale hole are present into which flushing medium can emerge and thus indicate that a seal is leaking. There is no major practical significance whether the sheath 31 is so long that it is present in the regions of the telltale holes 36, 37, or not. If the sheath 31 is so long that it is present in one of the regions of telltale holes 36, 37, the sheath 31 must, naturally, have its own telltale hole 38 in order to allow leaking flushing medium to pass. In order to simplify mounting and demounting, while at the same time ensuring that the sheath 31 is held in place in an effective manner, it may be most simple if the sheath 31 is so long that it is present in the region of the forward telltale hole 36, as shown in FIGS. 3-5.

The flush connector 25 and the sheath 31 are thus not exposed to the high impact forces from the stop ring 30 of the drilling machine and thus they do not need to be so mechanically strong. Also the flush housing 26 can be protected from the impact forces through a part of the front head 21 coming in between the flush housing 26 and the stop ring 30, or by having a small play between the flush housing 26 and the stop ring 30.

Since the flush connector 25 enters the sheath 31 but not the flush housing 26, it is possible also to use without problems a flush housing 26 according to the example shown in FIGS. 3-5, in which the flush housing 26 is mounted and demounted by means of rotation. However, the invention can of course be used independently of the type of flush housing that is used.

The working of the rust-resistant material, which is more difficult, is minimised through the flush connector 25, the flush housing 26 and the sheath 21 being relatively small fittings.

Thus, the purpose of the sheath 31 is to protect against rust solely where this is necessary, while the remainder of the front head 21 can be manufactured from traditional case-hardened steel, which is cheaper, easier to work, and has better mechanical properties. The invention thus combines the positive properties of case-hardened steel with the rust-protective effect of the rust-resistant material.

A rock drilling machine as described above can be used as usual in a drill rig.

The invention is, naturally, not limited to the example described above: it can be modified within the scope of the attached patent claims.

The invention claimed is:

1. A percussion rock drilling machine comprising a front head, in which front head are arranged a flush housing and a flush connector, wherein a sheath of rust-resistant material is arranged in the front head around the flush housing, such that flushing medium can enter the flush housing through the flush connector, without coming into contact with the front head; said flush housing, said sheath, and said flush connector being arranged such that said flushing medium enters the flush housing through from the flush connector through aligned sidewall openings in the sheath and the flush housing, respectively, wherein the flush connector is connected such that it enters one said opening in the sheath, and wherein the flush connector furthermore is connected such that it does not enter the flush housing.

2. The percussion rock drilling machine according to claim 1, wherein the rock drilling machine further comprises a shank adapter and a stop ring for the shank adapter; and that the sheath is arranged such that it is not in contact with the stop ring.

3. A drill rig, wherein said drill rig is equipped with a percussion rock drilling machine according to claim 1.

4. A drill rig, wherein said drill rig is equipped with a percussion rock drilling machine according to claim 2.

5. The percussion rock drilling machine according to claim 1, wherein said flush housing is formed from a rust-resistant material.

6. The percussion rock drilling machine according to claim 1, wherein said flush connector is formed from a rust-resistant material.

7. The percussion rock drilling machine according to claim 1, wherein said front head, other than said flush housing, said flush connector, and said sheath, is formed from case-hardened steel.

8. The percussion rock drilling machine according to claim 1, wherein both said flush housing and said flush connector are formed from a rust-resistant material.

9. The percussion rock drilling machine according to claim 8, wherein said front head, other than said flush housing, said flush connector, and said sheath, is formed from case-hardened steel.

* * * * *